United States Patent [19]

Christian

[11] Patent Number: 4,881,563

[45] Date of Patent: Nov. 21, 1989

[54] PAINT COLOR CHANGE SYSTEM

[75] Inventor: Robert L. Christian, Livonia, Mich.

[73] Assignee: General Motors Corporation, Detroit, Mich.

[21] Appl. No.: 904,167

[22] Filed: Sep. 5, 1986

[51] Int. Cl.[4] ..... B08B 3/02

[52] U.S. Cl. ..... 134/166 C; 134/102; 134/95; 134/169 C; 118/302; 118/698; 239/106; 239/311

[58] Field of Search ..... 118/302, 698; 134/94, 134/95, 98, 99, 102, 198, 166 C, 167 C, 168 C, 169 C; 239/106, 311

[56] References Cited

U.S. PATENT DOCUMENTS

| | | | |
|---|---|---|---|
| 3,155,539 | 11/1964 | Jumnall | 118/302 X |
| 3,169,545 | 2/1965 | Kolling | 239/311 X |
| 3,179,341 | 4/1965 | Plos et al. | 118/302 X |
| 3,348,774 | 10/1967 | Wiggins | 118/302 X |
| 3,385,522 | 5/1968 | Kock | 118/302 X |
| 3,450,092 | 6/1969 | Kock | 118/302 X |
| 3,867,144 | 4/1975 | Madden et al. | 118/302 X |
| 4,337,282 | 6/1982 | Springer | 118/302 X |
| 4,375,865 | 3/1983 | Springer | 118/302 X |
| 4,403,736 | 9/1983 | Scharfenberger | 118/302 X |
| 4,653,691 | 3/1987 | Grime | 239/311 |

*Primary Examiner*—Frankie L. Stinson

*Attorney, Agent, or Firm*—Edward J. Biskup

[57] ABSTRACT

A paint color change system in which the paint flow passage of the paint supply line leading to a paint atomizer is cleaned using a scrubbing medium comprising a compressible carrier containing an atomized solvent.

2 Claims, 2 Drawing Sheets

PAINT COLOR CHANGE SYSTEM

Figure 1:
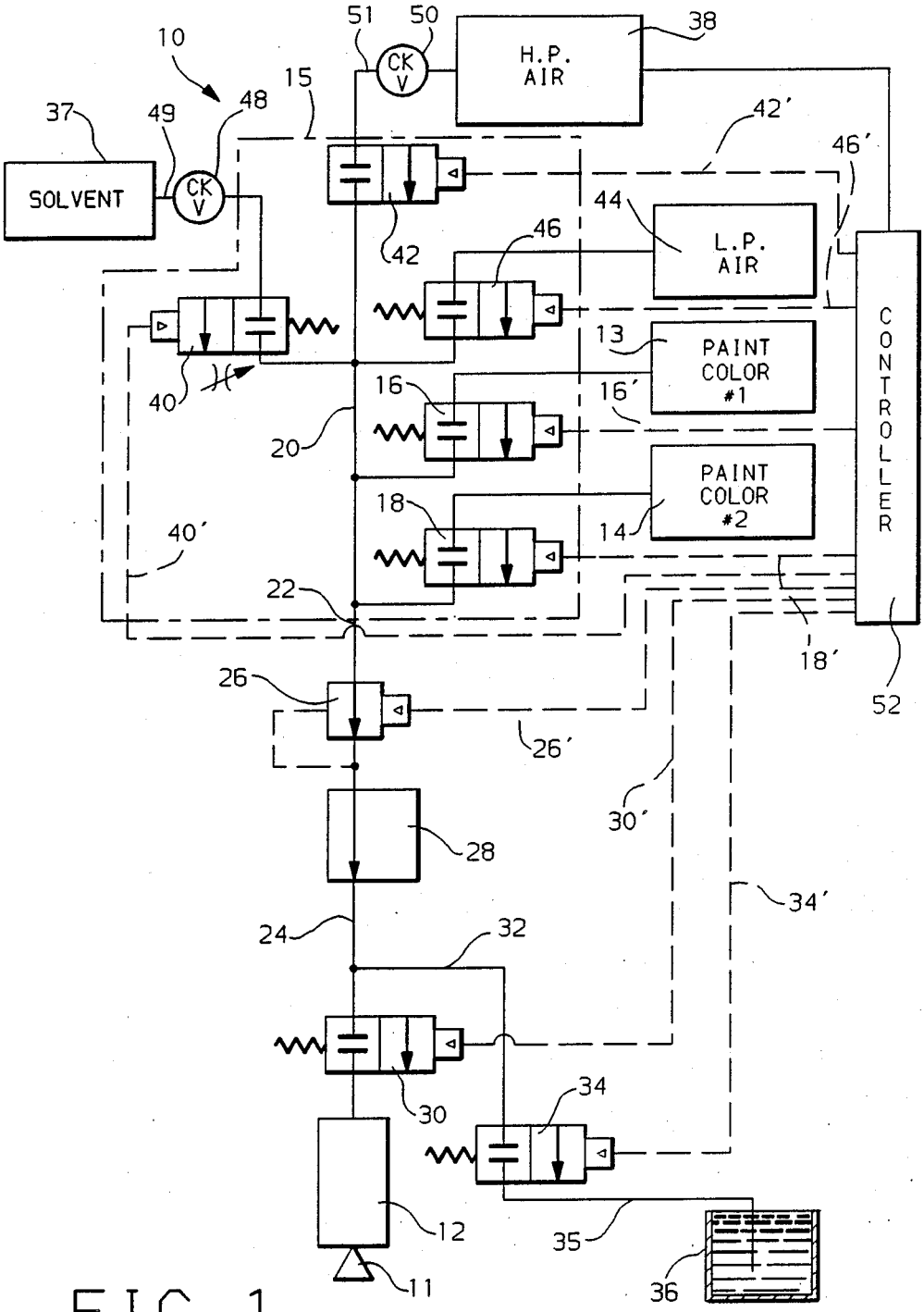

This invention concerns painting systems and more particularly a paint color change system and a method for cleaning the paint supply line connected to the atomizing device.

One type of painting system used on a production line for painting automobile bodies achieves a paint color change by initially using low pressure air to remove essentially all of the paint from the paint supply line. Subsequently, the paint residue in the paint supply line is cleaned by alternately opening and closing appropriate valves and providing pulses of air and solvent which flow through the paint supply line, through a dump valve and an exhaust line to a sump. Afterwards, the paint supply line is connected to a second source of paint of a different color for painting the next automobile body.

One problem with the above described paint color change system is that it requires a large amount of solvent to achieve the cleaning of the paint supply line. Another problem is that a thorough cleaning of the paint supply line is not always realized particularly when the color change is from a dark color such as red to a light color such as white. In such cases, it frequently is found that after the color change, the automobile body first painted has a pink hue rather than being white.

As a result, a need has existed for a new and improved paint color change system and method which would not only reduce the amount of solvent used for cleaning the paint supply line, but also clean the paint supply line more thoroughly so as to assure true color integrity immediately after a color change. To this end, I have discovered that if, between paint color changes, the cleaning solvent is placed in an atomized state and then propelled through the supply line at a high velocity, the supply line is cleaned thoroughly permitting paint color changes from red to white without incurring the aforementioned problem. It is believed that the improved cleaning occurs because of the finely atomized particles of solvent being carried at high velocity through the supply line and producing a scrub action against the inner walls of the supply line. Not only does this method provide a better and more thorough cleaning of the supply line but, in addition, it reduces by approximately sixty-six percent the amount of solvent consumed during the cleaning cycle.

In the preferred form of my invention the improved cleaning is performed with a paint color change system which includes a rotary bell-type atomizing device being fed with paint by a paint supply line that is connected to a paint manifold. The paint manifold is provided with appropriate valves which connect the manifold to a first source of paint of a first color, a second source of paint of a second color, a source of solvent, a source of high pressure air and a source of low pressure air. As is conventional, a controller operates the valves in the proper sequence and in this case the paint supply line is initially connected to the first source of paint to fill the supply line with the first color paint to allow the atomizing device to paint the automobile body. Just prior to the article being completely painted, the supply line is disconnected from the first source of paint and connected to the source of low pressure air to have the remaining paint in the supply line used for completing the painting of the automobile body. When the supply line is essentially empty of paint, the atomizing device is bypassed by actuating a trigger valve and a dump valve so that the supply line is connected to a sump. Afterwards, the supply line is connected to a source of high pressure air and a metered flow of solvent is provided in the flow path of the pressurized air so as to cause the solvent to be atomized. The high pressure air serves to propel the atomized solvent in a compressible state through the supply line at a velocity sufficient to clean the walls of the inner passage of the paint supply line and permit the atomized droplets containing the removed paint to be deposited through the dump valve into the sump. When the cleaning cycle is completed, the supply line is connected to the second source of paint to allow the painting of the next automobile body with a paint of a different color.

Accordingly, the objects of the present invention are to provide a new and improved paint color change system and method in which the enclosed paint passage within a paint supply line leading to an atomizing device is cleaned by using an atomized solvent; to provide a new and improved paint color change system and method in which the paint flow passage of the paint supply line is cleaned using a scrubbing medium comprising a compressible carrier containing an atomized solvent; to provide a new and improved paint color change system in which the passage within the paint supply line is cleaned using an atomized solvent propelled by pressurized gas so as to create a high velocity flow of solvent droplets which scrub the walls of the passage to remove the residual paint film adhering to the walls; and to provide a new and improved paint color change system and method in which the residual paint coating the walls of the passage of a paint supply line is removed as a result of the high velocity impact of solvent in an atomized state against the paint coating on the walls of the paint supply line.

Figure 2:
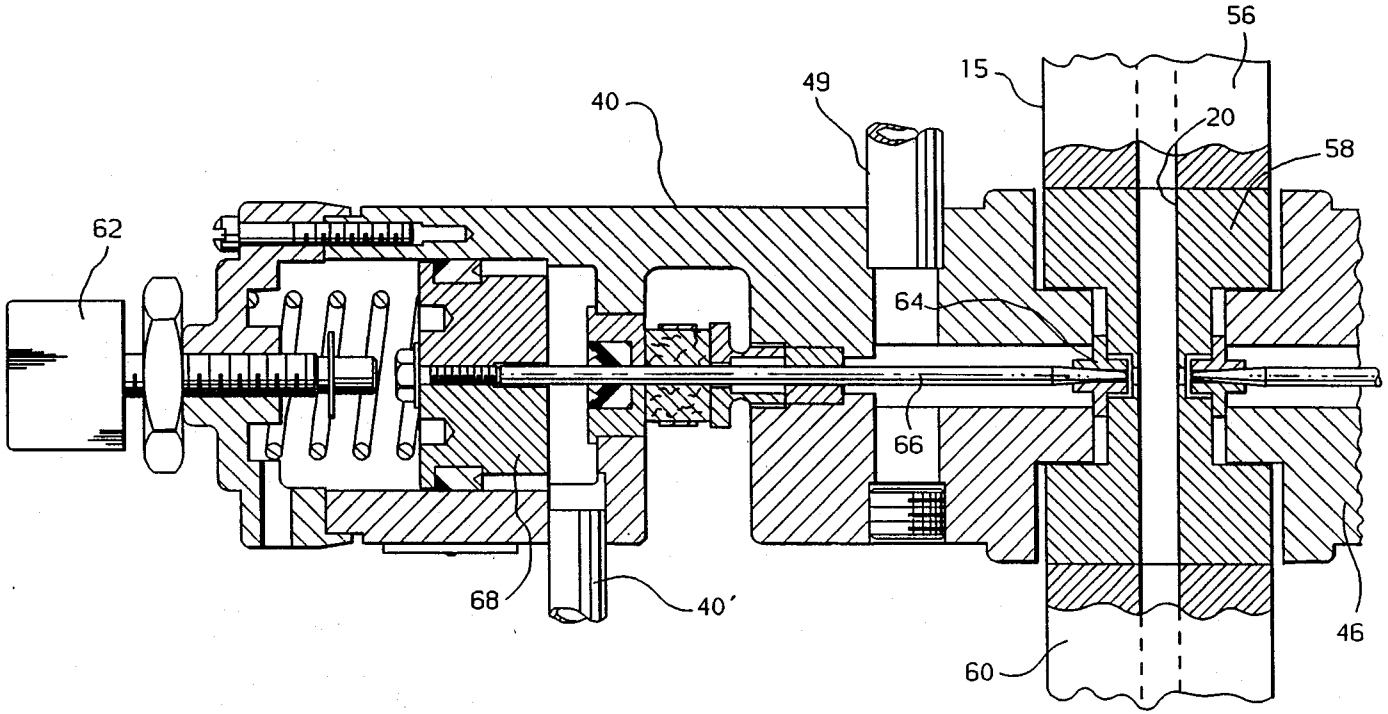

Other objects and advantages of the present invention will be apparent from the following detailed description when taken with the accompanying drawings in which:

FIG. 1 is a schematic diagram showing a paint color change system according to the present invention; and FIG. 2 shows the valve which provides a metered flow of solvent to the paint supply passage of the manifold shown in the schematic diagram of FIG. 1.

Referring now to the drawings and more particularly FIG. 1 thereof, a paint color change system 10 according to the present invention is shown as including a rotary electrostatic atomizer having a bell 11 of a conventional type adapted to be driven by an air turbine 12 at a high r.p.m. During the high speed rotation of the bell 11, liquid paint is fed to the bell 11 from one of two paint sources 13 and 14, and is mechanically atomized by the rotating bell. The bell is connected through a power generator to a power supply (not shown) and is increased by the power generator to 100,000 volts needed to electrostatically transfer the atomized paint particles to a grounded article such as an automobile body to be painted. The electrostatic field created between the bell 11 and the automobile body is of sufficient intensity to achieve the desired electrostatic deposition. Moreover, although not shown, the bell 11 can be carried by a robot or be moved by a mechanism which traverses the body for painting various parts of the body.

As alluded to above, the bell 11 is adapted to be selectively connected to two pressurized paint sources 13 and 14 which contain paint of two different colors. The respective paint sources 13 and 14 are connected to inlets of a paint manifold 15 and are controlled by normally closed pilot operated two-way valves 16 and 18. The valves 16 and 18 selectively connect the paint inlets to a common flow passage 20 which leads to a manifold outlet 22. The manifold outlet 22, in turn, connects with a paint supply line 24 through a downstream pilot operated regulator valve 26 and flow meter 28. The supply line 24 connects with the bell 11 through a pilot operated two-way normally closed valve 30. The supply line 24 is also connected to a short bypass line 32 that connects with a pilot operated two-way normally closed dump valve 34 which, in turn, is connected to an exhaust line 35 leading to a sump 36. A source 37 of solvent under pressure and a source 38 of high pressure air are connected through normally closed pilot operated two-way valves 40 and 42, respectively, to the flow passage 20 of the manifold 15. In addition, a source 44 of low pressure air is connected through a normally closed pilot operated two-way valve 46 to the flow passage 20 of the manifold 15. A check valve 48 is provided in the line 49 between the source 37 of solvent and the inlet to the valve 40. Similarly, a check valve 50 is provided in the line 51 between the source 38 of high pressure air and the inlet to the valve 42.

A controller 52 is connected to the source 38 of high pressure air and includes an electric controller operating solenoid valves (not shown) for selectively pressurizing pilot lines 16', 18', 30', 34', 40', 42', and 46' which are operatively connected to valves 16, 18, 30, 34, 40, 42 and 46 respectively. The electric controller operates the various solenoids in the proper sequence to obtain the desired paint system function. In other words, the controller 52 according to its programming will determine what color paint, if any, or cleaning solvent is supplied and for what length of time to the passage 20 as well as determine when the passage 20 is connected with the sources 38 and 44 of high pressure air and low pressure air, respectively. The controller 52 also controls operation of the valves 26, 30 and 34, the latter two of which serve to bypass the bell 11 and allow the solvent to flow from the supply line 24 through the exhaust line 35 to the sump 36 during the cleaning cycle. In addition, part of the controller 52 is an air pressure regulator to determine pilot pressure applied to valve 26.

In operation, the automobile body is initially presented to the atomizer for painting and it can be assumed that it requires the color provided by the paint source 13. When the automobile body is properly located relative to the bell 11, the controller 52 will open valves 16, 26 and 30 and activate the air turbine drive 12. Paint emanating from the source 13 will flow through the valve 16, passage 20, through valve 26, flow meter 28, supply line 24 and valve 30 to the bell 11. The rotating bell 11 will then atomize the paint and coat the automobile body. When the automobile body is nearly completed such that there is sufficient paint remaining in the supply line 24 to finish the painting job, the valve 16 will be closed and valve 46 will be opened to allow air at a pressure of approximately 50 to 60 psi to be supplied from the source 44 to the passage 20. This low pressure air serves to push out the paint in the supply line 24 to complete painting of the automobile body. When the supply line 24 is essentially empty of paint, the automobile body is completely painted and the valve 30 is closed and the valve 34 is opened. At the same time the valve 46 is closed and the valves 40 and 42 are opened. This begins the cleaning cycle at which time the source 38 supplies air at a pressure of approximately 100 psi to the passage 20. Simultaneously, a metered amount of solvent is presented to the passage 20 by the valve 40 while the high pressure air flows through the passage 20. During this time, sufficient pressurized air is provided in the pilot line 26' to assure that the valve 26 is maintained in the open position. As the air flows past the open valve 40, it creates a venturi effect causing the solvent to be aspirated into the high velocity flowing air and atomized thereby. The finely atomized droplets of solvent are carried at high speed to produce a scrubbing action against the interior walls of both the passage 20 and the passage in the supply line 24 thus, in effect, blasting the residual coating of paint off of the interior walls. The atomized solvent containing the paint from the interior walls of the passage 20 and of the passage in the supply line 24 is carried through the open dump valve 34 through the passage in the exhaust line 35 to the sump 36. Just prior to completing the cleaning cycle of the supply line 24, the valve 30 is opened for a fraction of a second to remove any residue paint in the bell 11. In addition, if needed, a separate system can be used to clean the face of the bell 11. After the cleaning cycle, the valves 40 and 42 are closed and valve 18 is open causing the paint from the source 14 to flow via the passage 20, outlet 22, valve 26, flow meter 28, paint supply line 24, line 32 and dump valve 34 to the sump 36. Once the supply line 24 is filled, valve 30 is opened and valve 34 is closed so as to condition the bell 11 for applying atomized paint of a different color onto the next automobile body.

A paint color change system such as shown in FIG. 1 has been built and successfully tested and the valves 16, 18, 42, and 46 used were Model 70719 valves made by Ransburg Electrostatic Equipment, Inc. located at P.0. Box 88220, Indianapolis, Indiana. Each of the Ransburg valves 16, 18, 42 and 46 had a stop screw rather than an adjustment screw and incorporated a high capacity needle seat and needle valve designed to provide full capacity flow when the valve needle was opened. These Ransburg valves were connected to a series of interconnected Ransburg porting blocks, as seen in FIG. 2 and identified by the reference numerals 56, 58, and 60, having the flow passage of each porting block arranged so as to communicate with the flow passage of the other so as to provide the flow passage 20. The valve 40 was also a Model 70719 Ransburg valve but, in this case, and as seen in FIG. 2 had an adjustment screw 62 and a needle seat 64 identified as the fine metering model accommodating a fine metering valve needle 66 connected to a piston 68. The flow meter 28 used in the system was a Model D Mass Flow Meter made by Micro Motion, 7070 Winchester Circle, Boulder, Colorado, and the valve 26 was a so-called Binks "peanut" regulator valve made by Binks Manufacturing Company. The "peanut" regulator valve can be obtained from the Binks' offices located at 11996 Merriman Road, Livonia, Michigan. The valves 30 and 34 used in the system were made by DeVilbiss Company, Middleburg Heights, Ohio and each carried the U.S. patent marking 4,406,468 and was identified in a service catalog as Model CCV-402-SS. The supply line 24 was approximately 21 feet long and constituted a hose having a ½ inch outer diameter and a 3/16 inch inner diameter while the exhaust line 35 was approximately 15 feet long and had a ½ inch outer diameter and a ¼ inch inner diameter. Both hoses were purchased from Hose Specialties, 137 Victor Avenue, Detroit, Michigan 48203 under the identification of 70377-02 for the supply line 24 and 70377-03 for the exhaust line 35. Each of the paints used in the paint sources 13 and 14 was a high solids enamel primer surfacer purchased from E. I. DuPont, 950 Stephenson Drive, Troy, Mich., and was identified as 764–151 for the source 13 and 764–143 for the source 14. The reservoir 37 containing the solvent used in the system was pressurized at 110 psi. The solvent was purchased from Grow Group Inc., 3155 West Big Beaver Road, Troy, Mich. and was identified as No. 6232 solvent.

In operating the system having the components described above, it was found that excellent cleaning of the supply line 24 was attained during the cleaning cycle when the adjustment screw 62 of valve 40 had been turned down to a fully closed position and then backed out slightly more than one full turn of the adjustment screw 62. In such position of the needle valve 66, when the valve 40 was opened during the cleaning cycle, it was found that only approximately 70 cc of solvent was used to clean the supply line 24 during a time period of approximately 2.9 seconds. This compares with having to use approximately 300 cc with the old purging system where solid solvent and air alternately were pushed through the paint supply line of the system. It is believed that the improved cleaning results are realized because, as aforementioned, the high velocity high pressure air flow through the passage 20, as seen in FIG. 2 creates a venturi effect adjacent the orifice in the needle seat 64 causing the solvent to be drawn into the high velocity stream of air and is atomized thereby into droplets. These droplets in turn travel through the supply line 24 and impact at a high speed against the residue coating of paint on the walls of the supply line and, in effect, scrub the paint off of the walls. As a result, a more thorough cleaning of the supply line occurs while utilizing essentially one third of the solvent previously used in the same time span.

Various changes and modifications can be made in the above described invention without departing from the spirit of the invention. Accordingly the inventor does not wish to be limited except by the scope of the appended claims.

The embodiments of the invention in which an exclusive property or privilege is claimed are defined as follows:

1. A paint color change system for supplying paint to an applicator means comprising, individual sources for at least two paints, a cleaning fluid, high pressure air and low pressure air, manifold means having a common passage for connecting said individual fluid sources to a paint supply line adapted to feed paint to said applicator means, said sources of at least two paints being connected to said common passage downstream of the connections of said source of cleaning fluid and said source of low pressure air to said common passage, said source of high pressure air being connected to said common passage upstream of the connection of said source of cleaning fluid with said common passage, valve means for selectively coupling said individual sources to said manifold, and a controller connected to said valve means and controlling operation thereof so that, after one of said sources of two paints is connected to said applicator means, the low pressure air is connected to the common passage and said supply line to remove essentially all of said one of said two paints followed by the simultaneous introduction into said supply line and said common passage of a metered flow of said cleaning fluid and said high pressure air so when the high pressure air flows by the connection of said common passage with said source of cleaning fluid the cleaning fluid is atomized into fine droplets which are propelled by the high velocity flow of said high pressure air against the residue paint coating the interior walls of said common passage and said supply line to effect removal of said residue paint.

2. A paint color system for supplying paint to an applicator means comprising, individual sources for at least two paints, a source of combined atomized cleaning fluid and high pressure air, and a source of low pressure air, manifold means for connecting all of said sources to a paint supply line adapted to feed paint to said applicator means, controller means for selectively coupling said individual sources to said manifold and controlling operation thereof so that, after one of said sources of two paints is connected to said applicator means, the source of low pressure air is connected to the manifold and the paint supply line to remove essentially all of said one of said two paints followed by the introduction into said paint supply line and manifold of said combined atomized cleaning fluid and high pressure air so the fine droplets of atomized cleaning fluid are propelled by the high velocity flow of said high pressure air against the residue paint coating the interior walls of said paint supply line and manifold to effect removal of said residue paint.

* * * * *